US005655873A

United States Patent [19]

Jobmann et al.

[11] Patent Number: 5,655,873

[45] Date of Patent: Aug. 12, 1997

[54] DRUM LIFTING ATTACHMENT FOR FORKLIFTS

[75] Inventors: Wolfgang Jobmann, P.O. Box 56 01 30, 2251 Hamburg, Germany; Uwe Stier, Hamburg, Germany; Michael D. Naugle, Seffner, Fla.

[73] Assignee: Wolfgang Jobmann, Hamburg, Germany

[21] Appl. No.: 542,442

[22] Filed: Oct. 12, 1995

[51] Int. Cl.[6] ..... B66F 9/18

[52] U.S. Cl. ..... 414/607; 294/90; 294/902; 294/103.1; 414/621

[58] Field of Search ..... 414/785, 607, 414/608, 626, 618, 619, 620, 621, 622, 623, 736, 911, 910; 294/119.4, 110.1, 87.2, 87.22, 87.1, 90, 106, 103.1, 104, 99.1, 902

[56] References Cited

U.S. PATENT DOCUMENTS

| | | | |
|---|---|---|---|
| 1,819,390 | 8/1931 | Seager | 294/119.1 X |
| 2,515,918 | 7/1950 | Weeks et al. | 294/67.33 |
| 2,789,858 | 4/1957 | Kughler | 294/119.1 X |
| 2,842,275 | 7/1958 | Kughler | 414/621 |
| 3,172,693 | 3/1965 | Hansen | 294/90 |
| 3,319,815 | 5/1967 | Vile | 414/607 |
| 3,352,591 | 11/1967 | Casey | 294/90 X |
| 3,363,929 | 1/1968 | Nelson | 414/619 X |
| 3,929,368 | 12/1975 | Ryden et al. | 294/103.1 |
| 4,018,468 | 4/1977 | Lundquist | 294/90 X |
| 4,135,655 | 1/1979 | Brown | 194/103.1 X |
| 4,272,220 | 6/1981 | Garcia | 414/607 |
| 4,318,661 | 3/1982 | Helm | 294/90 X |
| 4,951,990 | 8/1990 | Hollan et al. | 294/119.1 |
| 5,171,053 | 12/1992 | Rouleau | 294/106 |
| 5,236,298 | 8/1993 | Lehman | 414/607 |
| 5,390,795 | 2/1995 | Jobmann et al. | 206/515 |
| 5,441,322 | 8/1995 | Jobmann et al. | 294/90 |

FOREIGN PATENT DOCUMENTS

| | | | |
|---|---|---|---|
| 548380 | 11/1959 | Belgium | 294/119.1 |
| 109996 | 8/1968 | Denmark | 294/103.1 |
| 2576007 | 7/1986 | France | 294/90 |
| 253881 | 10/1993 | Japan | 294/902 |
| 8701885 | 3/1989 | Netherlands | 294/67.33 |
| 165373 | 11/1958 | Sweden | 294/119.1 |
| 1217659 | 3/1986 | U.S.S.R. | 294/902 |
| 1482883 | 5/1989 | U.S.S.R. | 414/607 |

OTHER PUBLICATIONS

The Liftomatic PNC™–Mar. 12, 1992.

*Primary Examiner*—Frank E. Werner
*Attorney, Agent, or Firm*—Brian S. Steinberger

[57] ABSTRACT

Drum lifting attachments for allowing forklift trucks to be able to raise and lower 55 gallon storage drums. A first embodiment includes a drum lifting attachment having two pairs of arcuate lifting arms positioned side-by-side to allow for lifting two 55 gallon plastic drums simultaneously. This embodiment includes a pair of arcuate arms for each drum. A rotatable rectangular flap can fold-down over the portion of the side-by-side connection between the two pairs of arcuate arms inorder to allow for the lifting of a different diameter sized drum. Optionally, the fold-down flap can have arcuate shaped sides. Optionally, plural flaps of increasing sizes can be folded down to adjust for the different diameter drums. A second embodiment includes a forklifting attachment that includes four sets of arcuate arms for allowing four 55 gallon drums to be able to be lifted simultaneously. The drums to be lifted in include standard 55 gallon metal drums, 55 gallon conical drums and drum sizes of varying diameters. Each of the embodiments include attachment couplers for hooking about the standard parallel forks of a forklifting truck. The drum lifting attachments can be formed from galvanized steel, stainless steel, and combinations thereof. The lifting attachments are able to lift and lower two drums and four drums simultaneously.

10 Claims, 6 Drawing Sheets

DRUM LIFTING ATTACHMENT FOR FORKLIFTS

This invention relates to lifting devices, and in particular to drum lifting attachments for use with forklifts that enable plural drums to be raised and lowered simultaneously. This invention relates to Applicants' U.S. Pat. No. 5,390,795, entitled Conical Drum Storage Container; and to U.S. Pat. No. 5,441,322 entitled: Apparatus for Lifting Drums, which are both incorporated by reference.

BACKGROUND AND PRIOR ART

Goods such as oil, frozen foods and the like have generally required the transportation and storage of large 55 gallon drums between warehouses, cargo ships, trains and tracks. Standard lifting devices for 55 gallon drums including metal and plastic drums that are used for storing products such as dry goods and liquids, have generally involved forklift trucks and their attachments. These standard lifting mechanisms have numerous problems and limitations. The standard parallel tow piece forks on the forklift can damage the drums. Fork lift type attachments are generally limited to an attachment that grips about the tops of single cylindrical drums.

U.S. Pat. No. 5,236,298 to Lehman only has the capability of lifting one drum at a time with a fork lift. Devices such as the Lehman system also have potential slippage problems since this device does not grip about the indented portions of a drum body and instead tries to broadly grip about the largest outer diameter dimension when lifting. Another problem with the single lift mechanism of Lehman is that the arcuate members are not fixably clamped in place during lifting and can separate during a lift causing a drum to fall and become damaged. Thus, the Lehman system cannot adequately lift conical plastic drums such as the drums described in U.S. Pat. No. 5,390,795, without causing damage to the drums themselves.

U.S. Pat. No. 4,272,220 to Garcia describes a drum lifting attachment for a forklift that is supposed to be able to lift two cylindrical drums. However, Garcia only provides for arcuate arms to be used at the extreme outside edges of the forklift attachment as shown in FIG. 6. In essence, each single drum being lifted is not adequately supported on all sides with the Garcia device. Like, Lehman, the Garcia device also cannot adequately lift conical plastic drums such as the drums described in U.S. Pat. No. 5,390,795 without causing damage to the drums themselves. Furthermore, the Garcia '220 patent does not provide for lifting drums of varying diameters, such that a smaller diameter drum cannot be safely lifted.

In addition no prior art is known to exist to the subject inventors that is capable of lifting four drums simultaneously. Thus, there is a need for a need for drum lifting attachments for forklifts that avoid the problems associated with the prior art lifters referred above.

SUMMARY OF THE INVENTION

The first objective of the present invention is to provide drum lifting attachments for forklifts capable of lifting two plastic 55 gallon drums at a time without damaging the drums.

The second objective of the present invention is to provide a drum lifting attachment for a forklift that provides two arcuate supports for adequately lifting a single 55 gallon drum.

The third object of this invention is to provide a drum lifting attachment for a forklift that can adjust to lift varying diameter sized drums.

The fourth object of this invention is to provide a drum lifting attachment that can safely and efficiently lift conical plastic drums.

The fifth object of this invention is to provide a drum lifting attachment for a forklift that can simultaneously lift and lower four drums at a time.

A first preferred embodiment includes a drum lifting attachment having two pairs of arcuate lifting arms positioned side-by-side that allow for lifting two 55 gallon plastic drums simultaneously. The first preferred embodiment includes a pair of arcuate arms for each drum. A rotatable rectangular flap can fold-down over the portion of the side-by-side connection between the two pairs of arcuate arms inorder to allow for the lifting of a different diameter sized drum. Optionally, the fold-down flap can have arcuate shaped sides. Optionally, plural flaps of increasing sizes can be folded down to adjust for the different diameter drums.

A second preferred embodiment includes a forklifting attachment that includes four sets of arcuate arms for allowing four 55 gallon drums to be able to be lifted simultaneously.

The embodiments can include attachment couplers for hooking about the standard parallel forks of a forklifting truck. The drum lifting attachments can be formed from galvanized steel, stainless steel, and combinations thereof. The drums to be lifted can be plastic conical 55 gallon storage drums or standard metal drums and the like.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
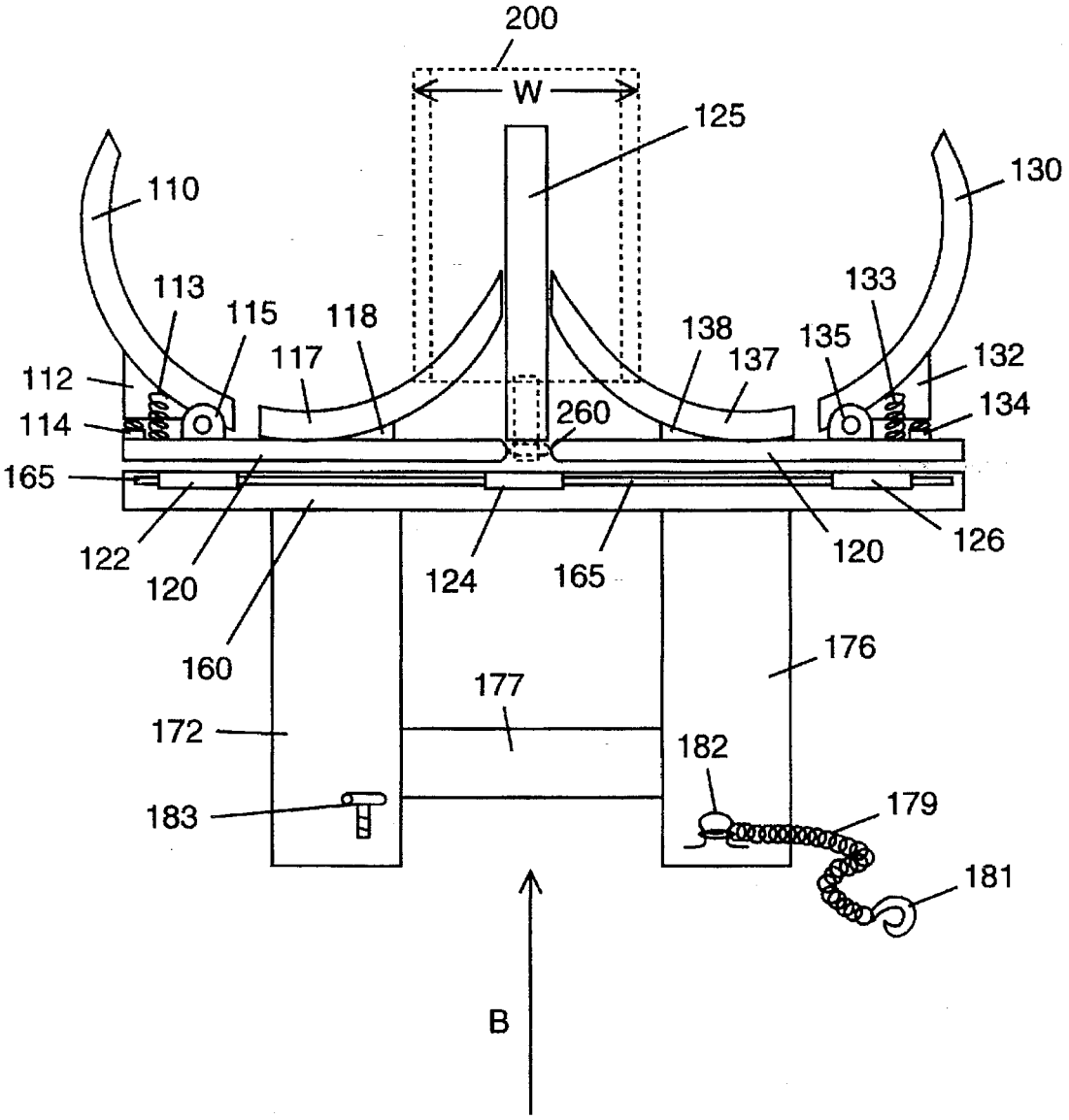
FIG. 1 is a top view of a first preferred embodiment of the drum lifting attachment for a forklift.
Figure 2:
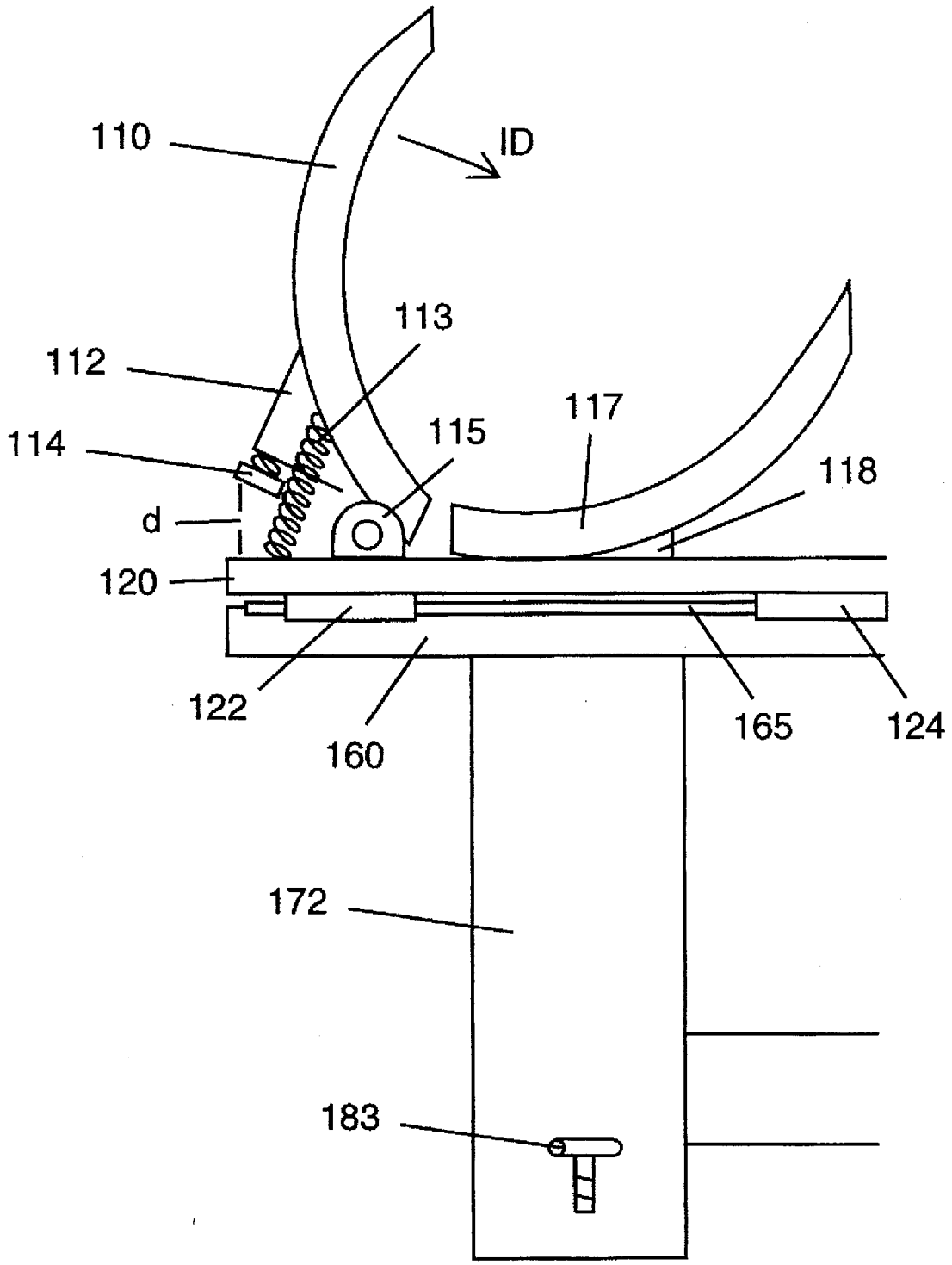
FIG. 2 is an enlarged view of a rotating arcuate arm of the embodiment of FIG. 1.
Figure 5:
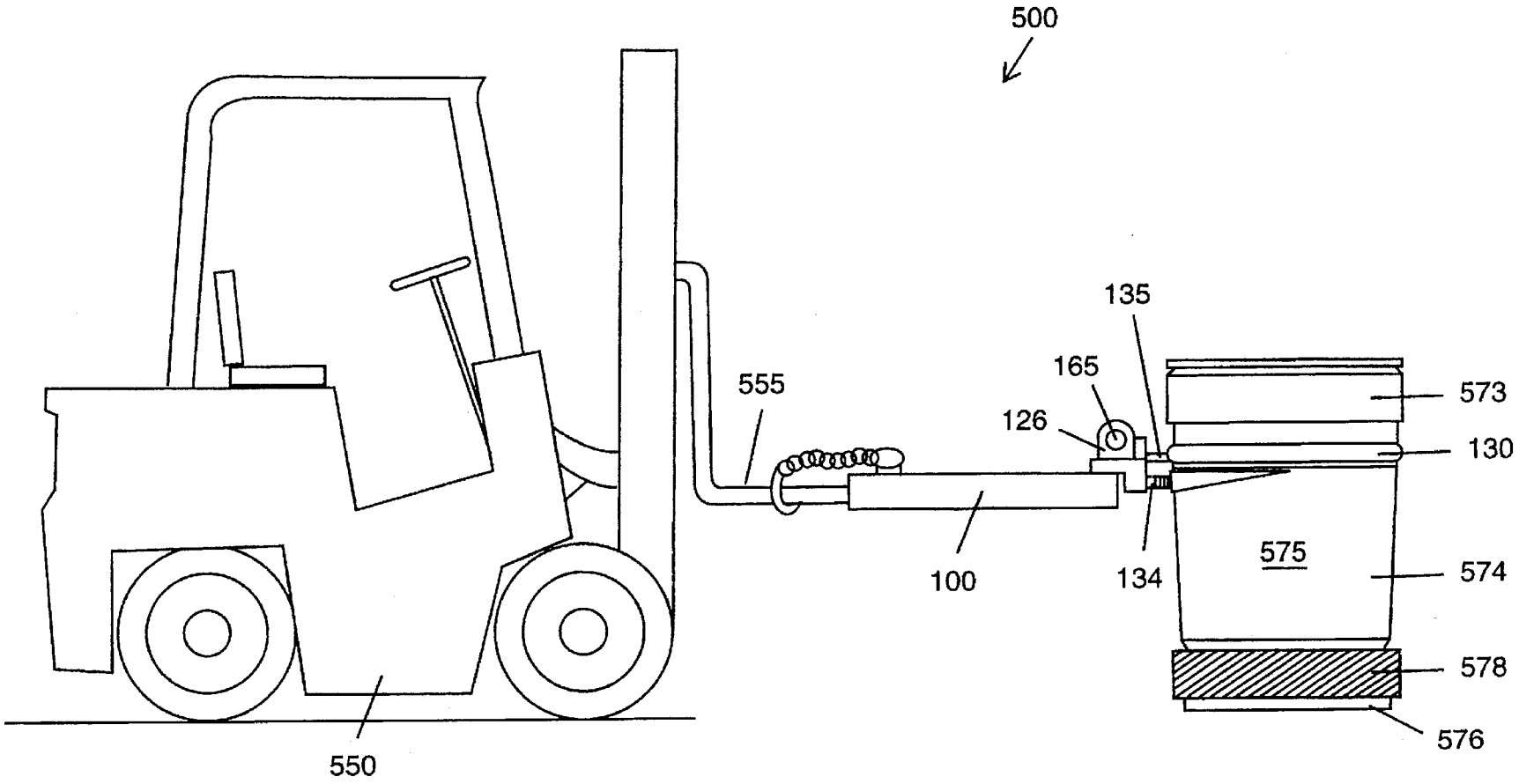
FIG. 5 is a side perspective view of the embodiment of FIG. 1 used by a forklift truck to lift a conical drum.

FIG. 1 is a top view of a first preferred embodiment 100 of the drum lifting attachment for a forklift. FIG. 2 is an enlarged view of a rotating arcuate arm of the embodiment of FIG. 1. Referring to FIGS. 1 and 2, embodiment 100 includes left side arcuate arm 110 including base member 112 with a threaded opening for receiving a radius adjustment screw 114 (more clearly shown in FIG. 2). The interior diameter, ID, created by arcuate arm 110 is dependent upon the amount screw 114 is tightened into base 112. In FIG. 2, arcuate arm 110 remains rotatable above rectangular base 120 about pivot point 115 where screw head 114 separates from rectangular base 120 up to distance, d. This rotation is helpful during several situations. For example, when the lifting attachment 100 is connected to a fork lift truck 550 so that the arm 110 will bend when touching an obstruction, and when the arm 110 approaches a conical type drum 575 to be lifted as shown in FIG. 5.

Referring to FIGS. 1–2, attachment 100 includes a first inside arcuate arm 117 that is fixed to rectangular base 120 by welding, soldering and the like, along surface 118. A center rod 125 can be welded to base 120, and separates a second set of arcuate arms 130 and 137. Right side arcuate arm 130 includes base member 132 with a threaded opening for receiving a radius adjustment screw 134. Rightside arcuate arm 130 remains rotatable above rectangular base 120 about pivot point 135 where screw head 134 can rest to abut against base 120. These components function similarly to the arcuate arm 110 and its related components.

Referring to FIGS. 1 and 2, rectangular base 120 includes metal cylinders 122, 124 and 126 that can be welded thereon. A metal rod 165 which is raised from and is attached to rectangular support 160 by welding, soldering and the like, so that base 120 can rotate relative to support 160.

Figure 3:
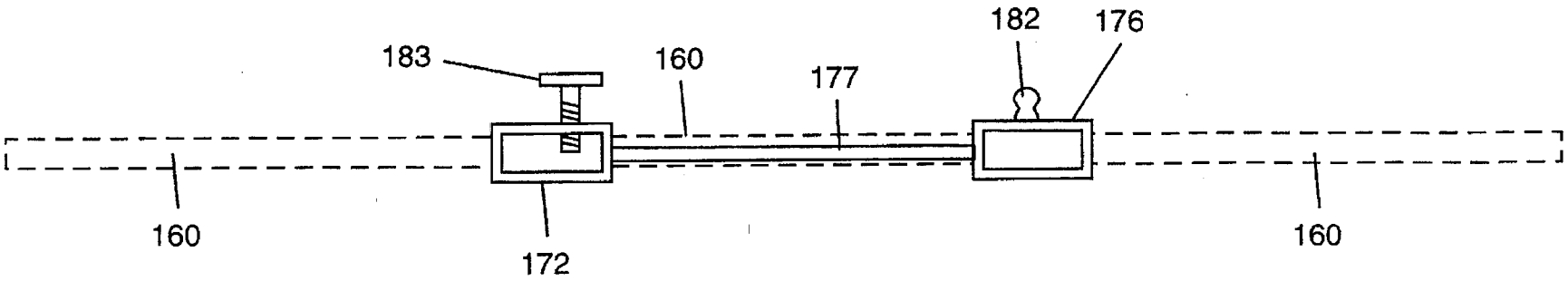
FIG. 3 is a side view of the embodiment of FIG. 1 along arrow B.

FIG. 3 is a side view of the embodiment of FIG. 1 along arrow B. Referring to FIGS. 1–3, fork lift tubes 172 and 176 are separated from one another by cross-strength bar 177. Fork lift tube 172 can include a threaded bolt 183 through a topside that can be tightened against an inserted fork 555 of a forklift truck 550, the latter shown in FIG. 5. The other fork lift tube can include a mount bracket 182 for attachment to a chain 179 and hook 181 which can be attached to a fork 555 of a forklift truck 550.

Figure 4B:
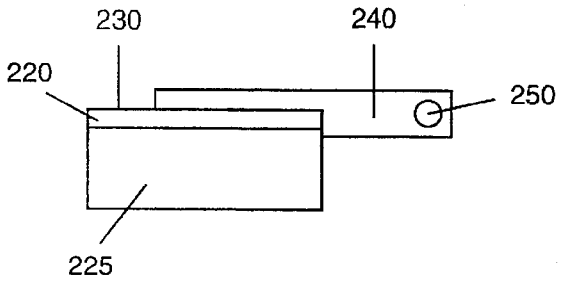
FIG. 4B is a side view of the rotatable flap of FIG. 4A along arrow C.
Figure 4A:
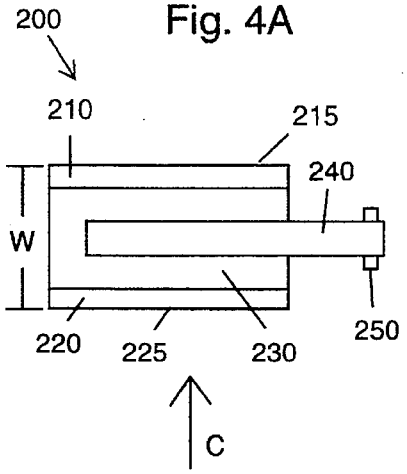
FIG. 4A is a top view of the rotatable flap of the embodiment of FIG. 1.

FIG. 4A is a top view of the rotatable flap 200 of the embodiment 100 of FIG. 1. FIG. 4B is a side view of the rotatable flap 200 of FIG. 4B along arrow C. Referring to FIGS. 1–3, 4A and 4B, rotatable flap 200 is rotatably attached to rectangular base 120 through rod 250 which can rotate within brackets 260 that are directly welded or soldered to base 120. Flap 200 includes side opposite side ledge portions 210 and 220, a top surface 230, sides 215 and 225, rotatable arm 240 and rod portion 250. In the down position as shown by the dotted lines shown in FIG. 1, the flap 200 has a width, w. Each set of arcuate arms 110, 117, and 137, 130 can have an initial diameter, that is reduced when flap 200 is lowered over fixed center rod 125. For example, the diameter between each pair of arcuate arms can be approximately 23 inches. After the flap 200 is lowered, the diameter between each of the arcuate arms can be lowered to approximately 21 and ½ inches. Thus, with the flap 200 in the upright position, the spacing between each of the arcuate arms can support cylindrical 55 gallon drums. With the flap 200 in the downward position, the arcuate arms can support a 55 gallon conical drum, or alternatively a 30 gallon cylindrical type drum.

Figure 4C:
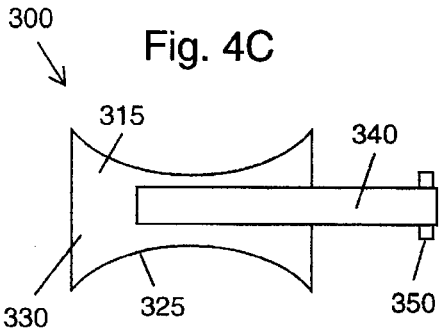
FIG. 4C is a top view of a second rotatable flap for use with the embodiment of FIG. 1.
Figure 4D:
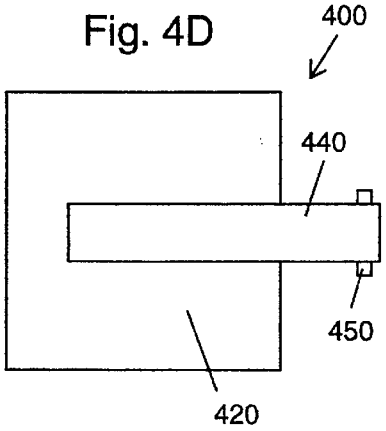
FIG. 4D is a top view of a third rotatable flap for use with the embodiment of FIG. 1.

FIG. 4C is a top view of a second rotatable flap 300 for use with the embodiment of FIG. 1. In FIG. 4C, flap 300 includes curved indented sides 315 and 325, on opposite sides of main body portion 330. A rotatable arm 340 attaches the flap to brackets 260 of embodiment 100 of FIG. 1 in a manner similar to that of flap 200 of FIGS. 4A–4B. The curved sides of the FIG. 4C version can mirror the arcuate arm shapes of the fixed arms 117 and 137 of embodiment 100, and allow for a closer grip about drums having rounded surfaces. FIG. 4D is a top view of a third rotatable flap 400 for use with the embodiment 100 of FIG. 1. Flap 400 can be square shape 420 with rotatable arm 440 and rod 450 that function in a manner similar to the previously disclosed flaps. Depending upon the diameter desired between each set of arcuate arms, FIGS. 4A–4D represent various sized flaps that can adjust for various diameters and fits when the lifting attachment of FIG. 1 is being utilized.

FIG. 5 is a side perspective view of the embodiment 100 of FIG. 1 used by a forklift truck 550 that is used to lift a conical drum 575, such as the drum disclosed in U.S. Pat. No. 5,390,795, by applicants, which is incorporated by reference. Rotatable arm 130 fits about the cone-shaped side area 574 which is located between top cylindrical section 573 and bottom cylindrical section 576. The generally cylindrical hollow container 575 has a top portion 573, a mid-portion 574 and a lower portion 576, the top portion 573 having an outer diameter which is larger than an outer diameter of the mid-portion 574 and the lower portion 576. The top portion 573 and bottom portion 576 are of a cylindrical configuration, and the mid-portion forms a conical configuration 574. About the bottom portion, 576, a removable bumper belt 578 can be located about the outer diameter of the lower portion 576. The belt 578 can have an outer diameter approximately the same as that of the outer diameter of the top portion 573 of the container 575.

Figure 6A:
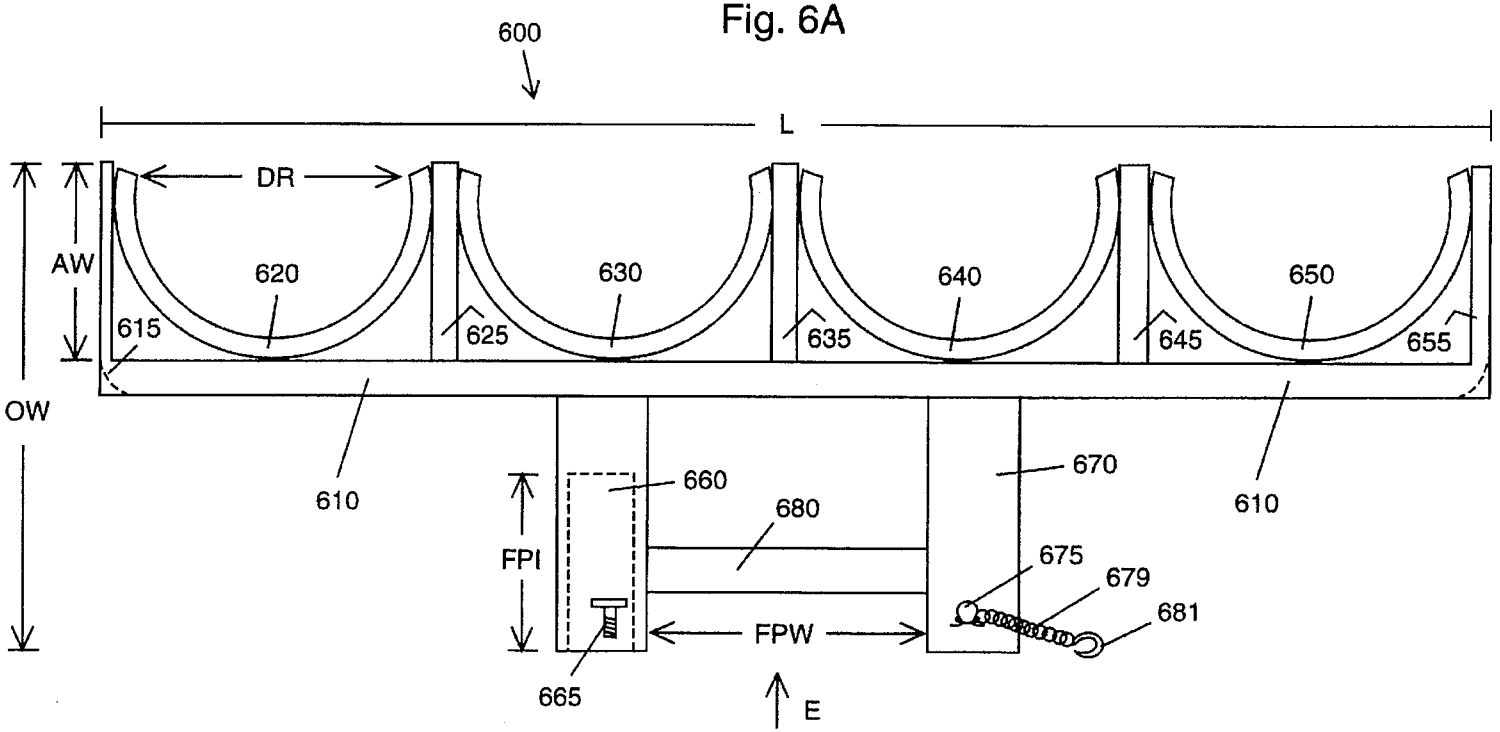
FIG. 6A is a top view of a second preferred embodiment drum lifting attachment for a forklift.
Figure 6B:
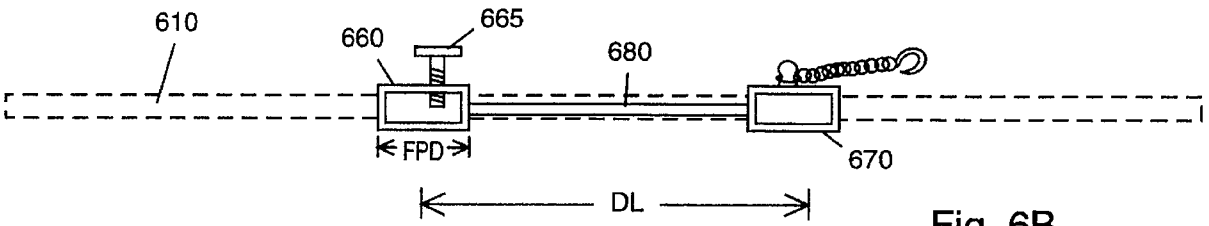
FIG. 6B is a side view of the embodiment of FIG. 6A along arrow E.

FIG. 6A is a top view of a second preferred embodiment 600 of a drum lifting attachment for a forklift. Embodiment 600 is used for lifting four 55 gallon drums simultaneously utilizing four fixed arcuate arms. FIG. 6B is a side view of the embodiment of FIG. 6A along arrow E. Referring to FIGS. 6A–6B, embodiment 600 includes a length, L of approximately 101 inches, an arcuate arm width, AW, of approximately 19 inches, an overall width, OW, of approximately 42 inches. Each of the arcuate arms 620, 630, 640, and 650, have respective drum radius's, DR, of approximately 21 and ½ inches. The forklift pocket tubes 660 and 670 are separated by a distance, FPW, of approximately 36 inches. The fork lift pocket tubes 660 and 670 can have a center distance, DL, of approximately 30 inches. Each of the forklift pocket tubes 660 and 670 have a depth, FPI, of approximately 20 inches, while the width of each forklift pocket, 660, and 670 has a width, FPD, of approximately 5 and ½ inches. Each of arcuate arms 620, 630, 640 and 650 can be fixably welded to base 610, side posts 615 and 655, and separated by respective center posts 625, 635 and 645. Base 610 can be welded to forklift pocket tubes 660 and 670 by welding. Cross brace 680 can be also attached to tubes 660 and 670 by welding and the like. Referring to FIGS. 6A–6B, tube 660 can include a tightening bolt 665 for attaching the embodiment 600 to the forks 555 of the forklift truck 550 of FIG. 5. Tube 670 can include a mount 675, chain 679 and hook 681 for attachment to one of the forks 555 of the forklift truck 550 of FIG. 5.

Although the first preferred embodiment describes two pairs of arcuate arms for lifting and lowering two drums, the invention can include one set of arms, and alternatively, three, four or more sets of arms.

All the components that form the embodiments described can be made from metal, galvanized steel, aluminum, stainless steel, and the like. Although the preferred embodiment has been described using chain connections, the embodiments can be used with cables, steel-metal shackles and the like.

Although, the preferred embodiments are described for lifting plastic conical plastic drums, the invention would have applicability to lifting other drum shapes and drums formed from metal, steel, aluminum, fiberglass and the like. Although, the preferred embodiment has been described for lifting 55 gallon drums, the invention would have equal applicability for lifting other size drums such as but not limited to 20, 30 and 40 gallon drums and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A drum lifting attachment for forklift trucks, comprising:

a base support connected to a forklift truck;

a first arcuate arm rotatably attached to the base support;

a second arcuate arm fixably attached to the base support, wherein the first arcuate arm and the second arcuate arm form a first diameter therebetween, the first arcuate arm and the second arcuate arm are sized to fit and grip about rounded sides of a first storage drum, for lifting and lowering the first storage drum;

a third arcuate arm rotatably attached to the base support;

a fourth arcuate arm fixably attached to the base support, wherein the third arcuate arm and the fourth arcuate arm form a second diameter therebetween, the third arcuate arm and the fourth arcuate arm are sized to fit and grip about rounded sides of a second storage drum, for lifting and lowering the second storage drum, the first arcuate arm, the second arcuate arm, the third arcuate arm and the fourth arcuate arm are located side-by-side to one another; and a folding flap hingedly attached to the base support having an upright position and a down position, the folding flap located between the second arcuate arm and the third arcuate arm, wherein the down position reduces the first diameter between the first and the second arcuate arms, and reduces the second diameter between the third and the fourth arcuate arms, the down position of the folding flap allowing storage drums having smaller diameters than the first and the second storage drums to be lifted by the first, second, third and fourth arcuate arms.

2. The drum lifting attachment for forklift trucks of claim 1, wherein the first and the second storage drums includes:

a conical storage drum.

3. The drum lifting attachment for forklift trucks of claim 2, wherein the conical storage drum further includes:

a generally cylindrical hollow container having a top portion, a mid-portion and a lower portion, the top portion having an outer diameter which is larger than an outer diameter of the mid-portion and the lower portion, wherein the top portion and bottom portion are of a cylindrical configuration, and the mid-portion forms a conical configuration; and a removable elastic bumper belt located about the outer diameter of the lower portion, the belt having an outer diameter approximately the same as that of the outer diameter of the top portion of the container.

4. The lifting attachment for forklift trucks of claim 1, wherein the folding flap includes:

a rectangular shape, wherein long sides of the rectangular shape engage edges of the storage drums having smaller diameters than the first and the second storage drums.

5. The lifting attachment for forklift trucks of claim 1, wherein the drum includes:

a cylindrical drum.

6. The lifting attachment for forklift trucks of claim 1, further comprising:

dual tubes attached to the base support, wherein the dual tubes fit about dual forks of a forklift truck.

7. The lifting attachment for forklift trucks of claim 6, wherein the dual tubes further include:

a hinge means for connecting the dual tubes to the base support, the hinge means allowing the dual tubes to pivot relative to the base support.

8. The lifting attachment for forklift trucks of claim 1, further comprising:

a radius adjustment screw attached between the first arcuate arm and the base for adjusting the radius of the first arcuate arm relative to the second arcuate arm; and a spring attached to the base support and to another point adjacent to the radius adjustment screw on the first arcuate arm, the spring causing a tension for holding the first arcuate arm in an open position that is limited only by the radius adjustment screw.

9. A dual drum lifting attachment for forklift trucks, comprising:

a base support connected to a forklift truck;

a first arcuate arm rotatably attached to the base support;

a second arcuate arm fixably attached to the base support, wherein the first arcuate arm and the second arcuate arm form a first diameter therebetween, the first arcuate arm and the second arcuate arm are sized to fit about and grip rounded sides of a first storage drum, for lifting and lowering the first storage drum;

a first radius adjustment screw attached between the base and the first arcuate arm for adjusting the radius of the first arcuate arm relative to the second arcuate arm;

a third arcuate arm rotatably attached to the base support;

a fourth arcuate arm fixably attached to the base support, wherein the third arcuate arm and the fourth arcuate arm form a second diameter therebetween, the first arcuate arm and the second arcuate arm are sized to fit about and grip rounded sides of a second storage drum, for lifting and lowering the second storage drum, the first arcuate arm, the second arcuate arm, the third arcuate arm and the fourth arcuate arm are located side-by-side to one another;

a second radius adjustment screw attached between the base and the third arcuate arm for adjusting the radius of the third arcuate arm relative to the fourth arcuate arm; and a folding flap hingedly connected to the base having an upright position and a down position, the folding flap located between the second arcuate arm and the third arcuate arm, wherein the down position reduces the first diameter between the first and the second arcuate arms, and reduces the second diameter between the third and the fourth arcuate arms, the down position of the folding flap allowing storage drums having smaller diameters than the first and the second storage drums to be lifted by the first, the second, the third and the fourth arcuate arms.

10. A drum supporting attachment for forklift trucks comprising:

a base attached to a forklift truck;

a first pair of arcuate arms attached to the base, the first pair of arcuate arms forming a first diameter for fitting about and lifting a first storage drum;

a second pair of arcuate arms attached to the base, the second pair of arcuate arms forming a second diameter for fitting about and lifting a second storage drum, the first pair of arcuate arms and the second pair of arcuate arms positioned side-by-side to one another;

a flap hingedly connected to the base between the first and second pair of arcuate arms, the flap having an up position and a down position for reducing the first diameter between the first pair of arcuate arms and for reducing the second diameter between the second pair of arcuate arms, wherein the down position of the folding flap allows for storage drums of smaller diameters than the first and the second storage drums to be lifted by the first and second pairs of arcuate arms.

* * * * *